US009295127B2

(12) United States Patent
Kim

(10) Patent No.: US 9,295,127 B2
(45) Date of Patent: Mar. 22, 2016

(54) POWER SUPPLY APPARATUS FOR LED LIGHTING AND LED LIGHTING APPARATUS USING THE POWER SUPPLY APPARATUS

(71) Applicant: SILICON WORKS CO., LTD., Daejeon-si (KR)

(72) Inventor: Yong Geun Kim, Suwon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 133 days.

(21) Appl. No.: 14/094,386

(22) Filed: Dec. 2, 2013

(65) Prior Publication Data

US 2014/0152192 A1 Jun. 5, 2014

(30) Foreign Application Priority Data

Nov. 30, 2012 (KR) ..... 10-2012-0138282

(51) Int. Cl.
*H05B 33/08* (2006.01)

(52) U.S. Cl.
CPC ..... *H05B 33/0848* (2013.01); *H05B 33/0854* (2013.01)

(58) Field of Classification Search
CPC ..... H05B 33/0848; H05B 33/0854; H05B 41/16; H05B 41/24
See application file for complete search history.

(56) References Cited

U.S. PATENT DOCUMENTS 8,222,832 B2 * 7/2012 Zheng et al. ..... 315/291

FOREIGN PATENT DOCUMENTS

| | | |
|---|---|---|
| JP | 2011-9701 | 1/2011 |
| JP | 2011-249031 | 12/2011 |
| KR | 10-2012-0044782 | 5/2012 |
| KR | 10-1164631 | 7/2012 |
| KR | 10-2012-0112048 | 10/2012 |

* cited by examiner

*Primary Examiner* — Hai L Nguyen
(74) *Attorney, Agent, or Firm* — Kile Park Reed & Houtteman PLLC

(57) ABSTRACT

Disclosed are a power supply apparatus for an LED lighting and an LED lighting apparatus using the power supply apparatus. The LED lighting apparatus includes a power source unit configured to supply a rectified voltage, a voltage converter configured to include at least one first inductor and to convert the rectified voltage, an auxiliary coil configured to include a second inductor and to supply a detection voltage corresponding to the current of the first inductor of the voltage converter, a controller configured to control the current of the voltage converter using a driving pulse generated in response to a control signal and a sensing voltage, and a voltage regulation circuit configured to regulate the detection voltage and to supply the regulated voltage as an operating voltage for the controller.

19 Claims, 4 Drawing Sheets

POWER SUPPLY APPARATUS FOR LED LIGHTING AND LED LIGHTING APPARATUS USING THE POWER SUPPLY APPARATUS

BACKGROUND OF THE INVENTION

1. Field of the Invention

The present invention relates to a Light-Emitting Diode (hereinafter referred to as an 'LED') lighting, and more particularly, to a power supply apparatus for an LED lighting and an LED lighting apparatus using the power supply apparatus.

2. Description of the Related Art

In recent lighting apparatuses, incandescent lights and fluorescent lights are being replaced with LEDs capable of being implemented to have a relatively longer lifespan, low consumption power, and high brightness as lighting lamps.

The lighting apparatus may include, for example, a security light and a streetlamp. An LED lighting apparatus that adopts an LED lighting is also developed as the security light or streetlamp and commercialized.

An example of a conventional LED lighting apparatus is disclosed in Korean Patent Registration No. 10-1164631. In this patent, a commercial AC power source supplies a power to LEDs through a Switching Mode Power Supply (SMPS) module and a driving circuit.

In general, an LED lighting apparatus is configured to supply a power to an LED by controlling the operation of a transformer in accordance with a flyback control method.

In order to drive the transformer in accordance with the flyback control method, an operating voltage needs to be stably supplied to a flyback control circuit.

The transformer does not operate in the initial state in which the supply of AC power is started. Accordingly, the flyback control circuit drives the transformer using an operating voltage according to a startup current.

When the transformer normally operates, the flyback control circuit receives the operating voltage from the auxiliary coil of the transformer.

The flyback control circuit may be differently designed depending on manufacturers, but can be designed to perform a stable operation in an environment in which an operating voltage of 14 V to 20 V is supplied.

Furthermore, an LED lighting apparatus may have a dimming function for controlling the brightness of an LED lighting.

The dimming function is to control the brightness of an LED lighting by controlling an electric current supplied to the LED lighting.

The dimming function may be designed so that an LED lighting is turned off when the duty of a control pulse is less than 10%. Furthermore, the dimming function may be implemented so that the brightness of an LED lighting is controlled when the duty of a control pulse varies between 10% and 100%.

The duty of the control pulse corresponds to the amount of current supplied to the LED lighting.

Accordingly, when an current that is less than 10% of a maximum driving current is supplied, the LED lighting is turned off because sufficient voltage for turning on the LED lighting is not formed. Furthermore, when an current between 10% and 100% of a maximum driving current is supplied, the LED lighting emits light with brightness corresponding to the amount of current.

A conventional LED lighting apparatus implemented to have a dimming function is problematic in that an operating voltage supplied to a flyback control circuit becomes unstable when the driving current of an LED lighting is decreased to a turn-off level.

More particularly, in the state in which the LED lighting is in a maximum driving current state, the LED lighting apparatus can supply an operating voltage having a stable level, such as 24 V, to the flyback control circuit through the auxiliary coil of a transformer.

If the brightness of the LED lighting is gradually decreased to a turn-off level by way of dimming control, however, the operating voltage supplied from the auxiliary coil of the transformer to the flyback control circuit is gradually decreased in proportion to a reduction of a driving current.

Furthermore, when the brightness of the LED lighting drops to a turn-off level, the operating voltage supplied from the auxiliary coil of the transformer to the flyback control circuit drops to an unstable level of 14 V or less.

That is, the conventional LED lighting apparatus is problematic in that the flyback control circuit unstably operates due to a low operating voltage because an operating voltage supplied from the auxiliary coil of the transformer to the flyback control circuit is excessively lowered when the brightness of the LED lighting is controlled in a turn-off level.

As described above, the conventional LED lighting apparatus is problematic in that the operation of the flyback control circuit becomes unstable when an LED lighting approaches a turn-off level in implementing a dimming function.

SUMMARY OF THE INVENTION

Accordingly, the present invention has been made in an effort to solve the problems occurring in the related art, and an object of the present invention is to provide a power supply apparatus for an LED lighting in which a dimming function capable of supplying a stable operating voltage to a flyback control circuit although the dimming control of an LED lighting is performed in a turn-off level has been implemented, and an LED lighting apparatus using the power supply apparatus.

Another object of the present invention is to provide a power supply apparatus for an LED lighting, which is capable of stabilizing an operating voltage supplied to a flyback control circuit by setting a winding ratio of the auxiliary coil of a transformer to any one of a step-down state, a step-up state, and a center set-up state and performing voltage regulation on detection voltage generated from the auxiliary coil in response to dimming control for each state, and an LED lighting apparatus using the power supply apparatus.

In order to achieve the above object, according to one aspect of the present invention, there is provided a power supply apparatus for an LED lighting, including a power source unit configured to supply a rectified voltage, a voltage converter configured to include at least one first inductor and to convert the rectified voltage, an auxiliary coil configured to include a second inductor and to supply a detection voltage corresponding to the current of the first inductor of the voltage converter, a controller configured to control the current of the voltage converter using a driving pulse generated in response to a control signal and a sensing voltage, and a voltage regulation circuit configured to regulate the detection voltage and to supply the regulated voltage as an operating voltage for the controller, wherein the control signal controls the dimming of an LED lighting, and the sensing voltage is voltage fed back after sensing the current of the voltage converter.

According to one aspect of the present invention, there is provided an LED lighting apparatus, including an LED lighting, a sensor board configured to provide a control signal for controlling the dimming of the LED lighting, and a power supply apparatus configured to include a power source unit configured to supply a rectified voltage, a voltage converter configured to include at least one first inductor and to convert the rectified voltage, an auxiliary coil configured to include a second inductor and to supply a detection voltage corresponding to the current of the first inductor of the voltage converter, a controller configured to control the current of the voltage converter using a driving pulse generated in response to a control signal and a sensing voltage fed back after sensing the current of the voltage converter, and a voltage regulation circuit configured to regulate the detection voltage and to supply the regulated voltage as an operating voltage for the controller and to supply a power to the LED lighting and a sensor board.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
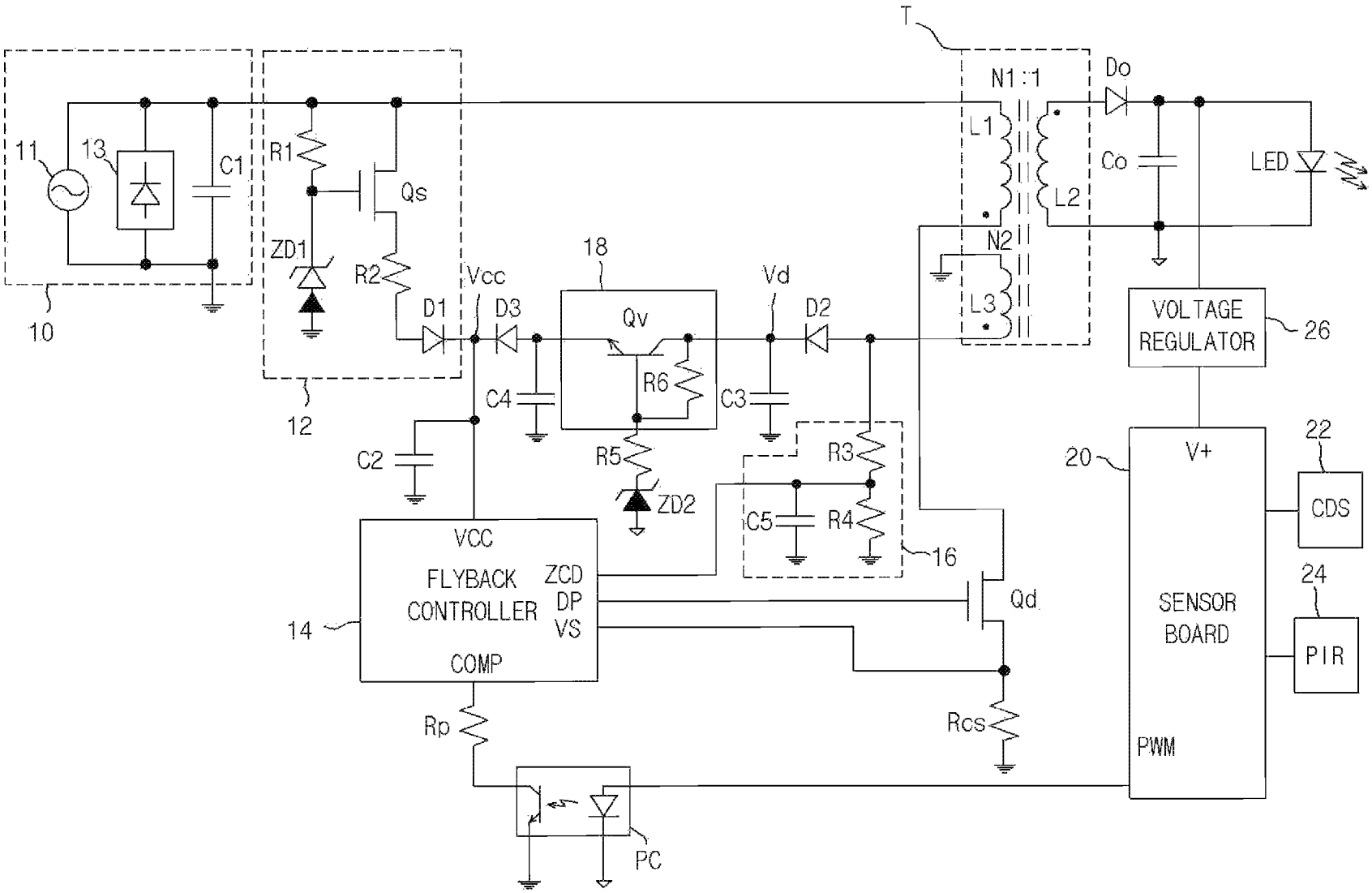
FIG. 1 is a circuit diagram showing an exemplary embodiment of an LED lighting apparatus in accordance with the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, an LED lighting apparatus in accordance with an embodiment of the present invention includes a power source unit 10, a transformer T, an LED lighting LED, a flyback control circuit, a startup circuit 12, a voltage regulation circuit, and a sensor board 20.

The power source unit 10 is configured to perform full-wave rectification on AC power and output the results of the full-wave rectification as rectified voltage. That is, the power source unit 10 has a structure in which a power source 12, a rectification circuit 13, and a capacitor C1 are connected in parallel. The power source 12 may use commercial power as AC power. The rectification circuit 13 is configured to perform full-wave rectification on AC power of a sine waveform that is supplied by the power source 12 and output the results of the full-wave rectification as rectified voltage having a ripple component. The capacitor C1 in parallel connected to the output terminal of the rectification circuit 13 functions to smooth the output of the rectification circuit 13. The rectified voltage generated from the power source unit 10 is transferred to the transformer T. The transformer T is configured to transform the rectified voltage into DC voltage and output the DC voltage.

The transformer T is configured to include a coil that forms a primary side L1, a coil that forms a secondary side L2, and an auxiliary coil L3. A winding ratio of the coils on the primary side L1 and the secondary side L2 of the transformer T may be set to N1:1. The transformer T illustrates a voltage converter including at least one inductor, and the at least one inductor of the voltage converter may corresponding to the coil of the primary side.

The auxiliary coil L3 illustrates an inductor. The auxiliary coil L3 is configured to output a detection voltage Vd corresponding to the current of the inductor of the transformer T that is formed of the voltage converter. Furthermore, the auxiliary coil L3 may be combined with the power transformer, that is, the transformer T, in accordance with a separation or non-separation (or insulation or non-insulation) method. A winding ratio of the auxiliary coil L3 and the primary side L1 may be set to N2:N1. Here, N1 and N2 are positive real numbers.

The winding ratio may be set to correspond to any one of a step-down state (first embodiment) in which the auxiliary coil L3 is configured to output the detection voltage Vd in a level equal to or higher than the turn-off level of the LED lighting LED, a step-up state (second embodiment) in which the auxiliary coil L3 is configured to output the detection voltage Vd in a level equal to a maximum driving voltage of the LED lighting LED, and a center set-up state (third embodiment) in which the auxiliary coil L3 is configured to output the detection voltage Vd in a level corresponding to the middle of the maximum driving voltage and the turn-off level of the LED lighting LED. The winding ratio may be selectively set depending on an intention of a manufacturer.

The transformer T has a construction in which an induction current is generated in the secondary side L2 by way of the flow of current on the primary side L1 to which the rectified voltage is applied and the induction current of the secondary side L2 is rectified, smoothed, and transformed into DC voltage through a diode D1 and a capacitor C2 and is then outputted.

Furthermore, the transformer T also induces an current in the auxiliary coil L3 by way of the flow of current on the primary side L1. The amount of current induced into the auxiliary coil L3 may vary depending on the winding ratio that is set to the step-up state, the step-down state, or the center set-up state.

The transform of rectified voltage in the transformer T is driven by a flyback control circuit which includes a flyback controller 14, a Zero Current Detection (ZCD) circuit 16, a switching element Qd, and a sensing element Rcs.

Furthermore, the output of the transformer T is supplied to the LED lighting LED and the sensor board 20 as a power.

Voltage for driving the LED lighting LED and an operating voltage V+ for the operation of the sensor board 20 have different levels. Accordingly, the output of the transformer T can be regulated by a voltage regulator 26 and provided as the operating voltage V+ of the sensor board 20. The voltage regulator 26 has been illustrated as being configured an additional element, but the voltage regulator 26 may be embedded in the sensor board 20 depending on an intention of a manufacturer.

The LED lighting LED may be configured to include one LED or two or more LEDs and preferably may be configured to have an array of a plurality of LEDs.

The sensor board 20 may be configured to include a visible light (or illuminance) sensor CDS 22 and an infrared sensor PIR 24. The visible light sensor 22 senses surrounding brightness (illuminance), and the infrared sensor 24 senses the human body.

The sensor board 20 may be configured to receive the operating voltage V+ obtained by regulating the output of the secondary side L2 of the transformer T through the voltage regulator 26 and output the control signal PWM. The control signal can be supplied as an analog signal or a PWM signal. It is assumed that the control signal is provided as the PWM signal for an operation in accordance with an embodiment of the present invention.

The control signal PWM may have a pulse width varied in response to the sensing of the visible light sensor 22 or the infrared sensor 24, and the control signal PWM having a varied pulse width may be outputted for dimming control. Furthermore, if the control signal PWM is outputted with a duty of less than 10%, the control signal PWM may be defined to turn off the LED lighting LED.

The startup circuit 12 is configured to detect a startup current supplied from the power source unit 10 to the primary side of the transformer T and supply the detected startup current as an operating voltage Vcc.

More particularly, the startup circuit 12 includes a transistor Qs in parallel connected to the capacitor C1 of the power source unit 10 and a resistor R1 and a zener diode ZD1 in parallel connected to the gate of the transistor Qs. The resistor R1 is coupled between the gate and source of the transistor Qs, and the zener diode ZD1 is coupled between the ground and the gate of the transistor Qs.

The startup circuit 12 further includes a resistor R2 and a forward diode D1 that are in series connected to the drain of the transistor Qs.

The startup circuit 12 configured as described above detects a startup current in an initial state in which power is supplied and outputs the operating voltage Vcc through the diode D1.

The startup circuit 12 outputs a constant voltage in accordance with an operating characteristic of the zener diode ZD1. For example, the zener diode ZD1 may have a constant voltage characteristic of 18 V. The startup circuit 12 can output voltage of 14 V to a node on the output side of the diode D1 as the operating voltage Vcc.

Furthermore, the voltage regulation circuit is configured to change the detection voltage Vd of the auxiliary coil L3 of the transformer T so that the detection voltage Vd satisfies an allowable range of the operating voltage Vcc and to output the changed voltage.

The allowable range of the operating voltage Vcc may be set to, for example, 10 V to 20 V. In the allowable range, the flyback controller 14 can perform a normal operation.

In the state in which the transformer T normally operates after power is supplied, the voltage regulation circuit supplies the operating voltage Vcc to the flyback controller 14 as the detection voltage Vd of the auxiliary coil L3 of the transformer T.

The construction of the voltage regulation circuit is described in more detail below.

The voltage regulation circuit includes a diode D2 connected to the auxiliary coil L3, a capacitor C3 and a DC-DC regulator 18 in parallel connected to the output terminal of the diode D2, a resistor R5 and a zener diode ZD2 in series connected to the DC-DC regulator 18 and configured to serve as a constant voltage source, a diode D3 connected to the output terminal of the DC-DC regulator 18, and a capacitor C4 in parallel connected to the output terminal of the diode D3.

The output terminal of the diode D3 is connected to the output terminal of the diode D1 of the startup circuit 12. A capacitor C2 is connected to a node to which the output terminals of the diode D3 and the diode D1 are connected in common. The operating voltage Vcc is applied to the flyback controller 14.

The zener diode ZD2 serves as a constant voltage source for driving a constant voltage in response to the detection voltage Vd and may have, for example, a constant voltage characteristic of 18 V.

Furthermore, the DC-DC regulator 18 is driven by a constant voltage supplied by the zener diode ZD2. More particularly, the DC-DC regulator 18 changes the detection voltage Vd in accordance with a ratio of the resistor R6 and the resistor R5 and outputs the changed voltage as the operating voltage Vcc. Here, the operating voltage Vcc has a minimum level and a maximum level so that it satisfies an allowable range in which the flyback controller 14 can operate. That is, the DC-DC regulator 18 regulates the detection voltage Vd and outputs the regulated voltage as the operating voltage Vcc.

To this end, the DC-DC regulator 18 may be configured to include an NPN bipolar transistor Qv having a collector and a base coupled through the resistor R6.

Meanwhile, the flyback control circuit is an example of a controller for controlling the current of the flyback transformer T, that is, a voltage converter, using a driving pulse generated in response to the control signal and a sensing signal. To this end, the flyback control circuit may be configured to include the flyback controller 14, the ZCD circuit 16, the switching element Qd, the sensing element Rcs, and a dimming control circuit.

That is, the flyback control circuit generates a driving pulse DP in response to the control signal PWM of the sensor board 20 for controlling dimming and a sensing voltage Vs that is generated by sensing the flow of current of the primary side L1 of the transformer T and then fed back and drives the primary side L1 of the transformer T using the driving pulse DP.

More particularly, the dimming control circuit of the flyback control circuit may be configured to include a photo coupler PC. The dimming control circuit converts the control signal PWM of the outside (e.g., the sensor board 20) for controlling dimming into a dimming control signal COMP.

That is, the control signal PWM of the sensor board 20 is received through the photo coupler PC, transferred through a transfer resistor Rp, and then inputted to the flyback controller 14 as the dimming control signal COMP.

Furthermore, the flyback controller 14 receives a ZCD signal ZCD from the ZCD circuit 16.

The ZCD circuit 16 is supplied with the output current of the auxiliary coil L3 of the transformer T in order to detect a zero current point Z of an electric current that is induced into the secondary side L2 of the transformer T.

The ZCD circuit 16 is configured to output a Zero Current Detection (ZCD) signal that is a result of the detection of a zero current point (refer to Z in FIG. 2) of an electric current induced into the secondary side L2 of the transformer T, that is, the output current of the auxiliary coil L3.

To this end, the ZCD circuit 16 may be configured to include a resistor R3 connected to the auxiliary coil L3 of the transformer T and a resistor R4 and a capacitor C5 in parallel connected to the resistor R3. The ZCD circuit 16 outputs the ZCD signal ZCD to the flyback controller 14 through a node between the resistor R3 and the resistor R4.

Figure 2:
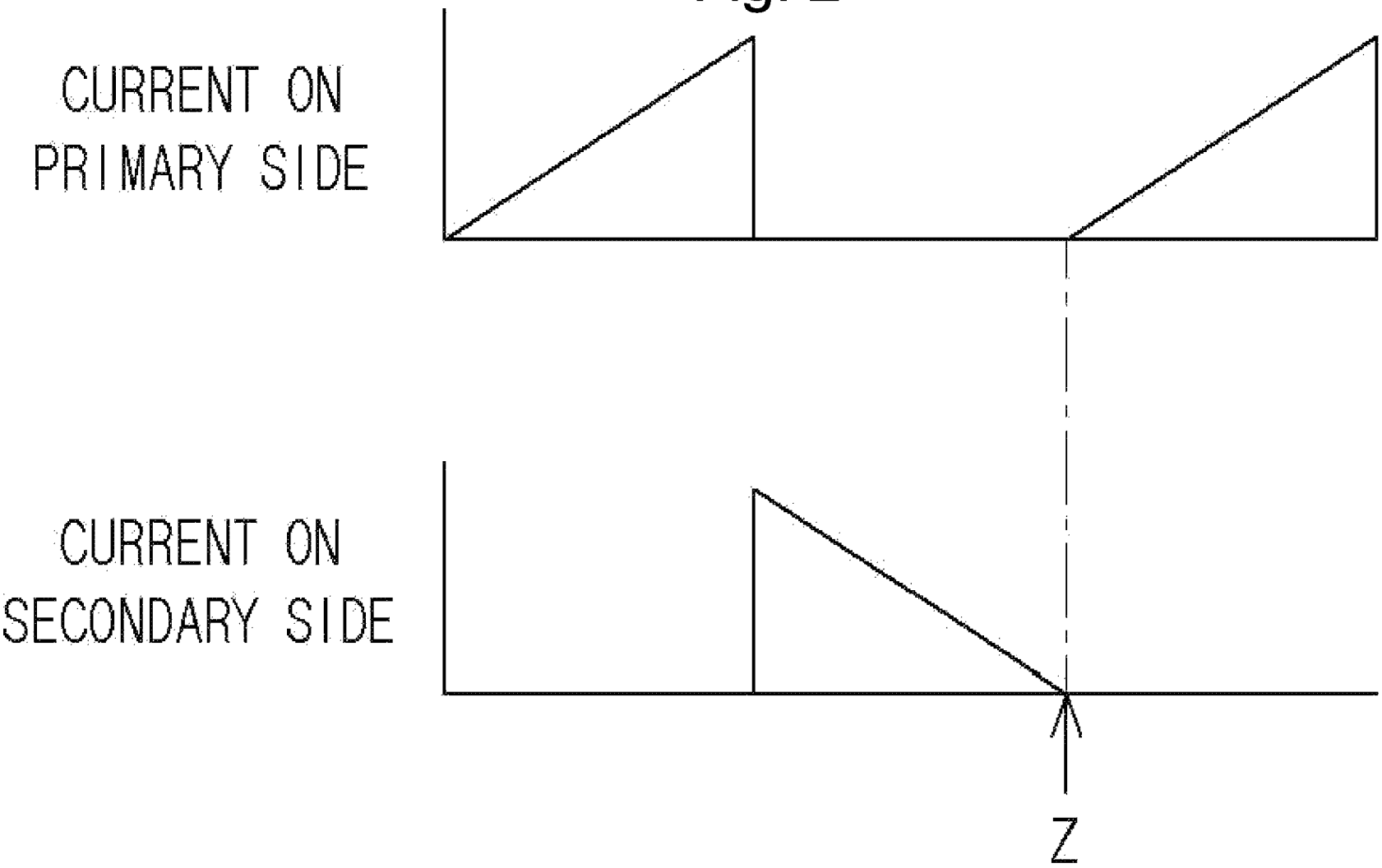
FIG. 2 shows a current waveform on the primary side and the secondary side of a transformer.

Referring to FIG. 2, when the switching element Qd is turned on, an current on the primary side L1 of the transformer T slowly rises. At this time, an induction current is not formed in the secondary side L2.

When the switching element Qd is turned off, the flow of current on the primary side L1 of the transformer T is suddenly blocked, and an induction current is formed in the secondary side L2 and then gradually reduced.

The zero current point Z means a point of time at which the induction current on the secondary side L2 of the transformer T disappears, that is, a point of time at which the induction current becomes a zero state.

When the zero current point Z is reached, the flow of current on the primary side L1 of the transformer T is increased by the turn-on of the switching element Qd.

That is, the flow of current on the primary side L1 of the transformer T is initiated in synchronization with the zero current point Z, thereby being capable of reducing a switching loss and improving total transform efficiency.

The ZCD circuit 16 supplies a signal that has been synchronized with the zero current point Z as the ZCD signal ZCD.

Meanwhile, the switching element Qd is connected to the primary side L1 of the transformer T, and the switching element Qd is grounded through the sensing resistor Rcs.

The switching element Qd may be formed of an FET, that is, a power transistor, and is switched in response to the driving pulse DP applied to the gate of the switching element Qd.

The switching element Qd drives the flow of current on the primary side L1 of the transformer T by way of the switching.

The sensing resistor Rcs is a sensing element and configured to sense the flow of current of the switching element Qd and to supply a result of the sensing to the flyback controller 14 as the sensing voltage Vs.

The flyback controller 14 is driven in response to the operating voltage Vcc. Furthermore, the flyback controller 14 internally generates the driving pulse DP and supplies the driving pulse DP to the switching element Qd.

That is, a point of time at which the driving pulse DP is enabled is synchronized with a zero current point in response to the ZCD signal ZCD, and the flyback controller 14 outputs the driving pulse DP having a pulse width determined in response to the dimming control signal COMP and the sensing voltage Vs.

First, an example in which the flyback controller 14 changes the width of the driving pulse DP in response to the dimming control signal COMP and outputs the driving pulse DP having a changed pulse width is described below.

If the illuminance sensor 22 senses that surroundings are dark, the sensor board 20 may output the control signal PWM having a wide pulse width in order to light up the LED lighting LED. On the contrary, if the illuminance sensor 22 senses that surroundings are bright, the sensor board 20 may output the control signal PWM having a narrow pulse width in order to dim the LED lighting LED.

When the dimming control signal COM corresponding to the control signal PWM having a varying pulse width is received as described above, the flyback controller 14 outputs the driving pulse DP having a wide pulse width in order to light up the LED lighting LED and outputs the driving pulse DP having a narrow pulse width in order to dim the LED lighting LED.

Accordingly, if the driving pulse DP has a wide pulse width, the transformer T can be driven to output a large amount of current because the time when the switching element Qd is turned on is long. If the driving pulse DP has a narrow pulse width, the transformer T can be driven to output a small amount of current because the time when the switching element Qd is turned on is short.

As a result, the LED lighting LED can emit light brightly or darkly in response to the amount of current supplied by the transformer T.

Furthermore, the flyback controller 14 can change the width of the driving pulse DP in response to the sensing voltage Vs and output the driving pulse DP having a changed pulse width. The transformer T needs to maintain an output current if the dimming control signal COMP remains constant. The sensing voltage Vs is used to regularly maintain the amount of current outputted from the transformer T as described above.

If the amount of current outputted from the transformer T is increased, the amount of current introduced into the sensing resistor Rcs through the switching element Qd is also increased. On the contrary, if the amount of current outputted from the transformer T is decreased, the amount of current introduced into the sensing resistor Rcs through the switching element Qd is also decreased.

The sensing resistor Rs provides the flyback controller 14 with the sensing voltage Vs corresponding to the amount of current.

The flyback controller 14 outputs the driving pulse DP having a wide pulse width in order to increase the amount of current outputted from the transformer T or outputs the driving pulse DP having a narrow pulse width in order to reduce the amount of current outputted from the transformer T with reference to the sensing voltage Vs.

In the LED lighting apparatus configured and driven as described above in accordance with an embodiment of the present invention, the DC-DC regulator 18 outputs the operating voltage Vcc of 14 V to 20 V for a stable operation of the flyback controller 14.

Accordingly, in an embodiment of the present invention, although the driving current of an LED lighting is reduced to a turn-off level for dimming control, the operating voltage Vcc having a stable level of 14 V or higher can be supplied to the flyback controller 14.

Figure 3:
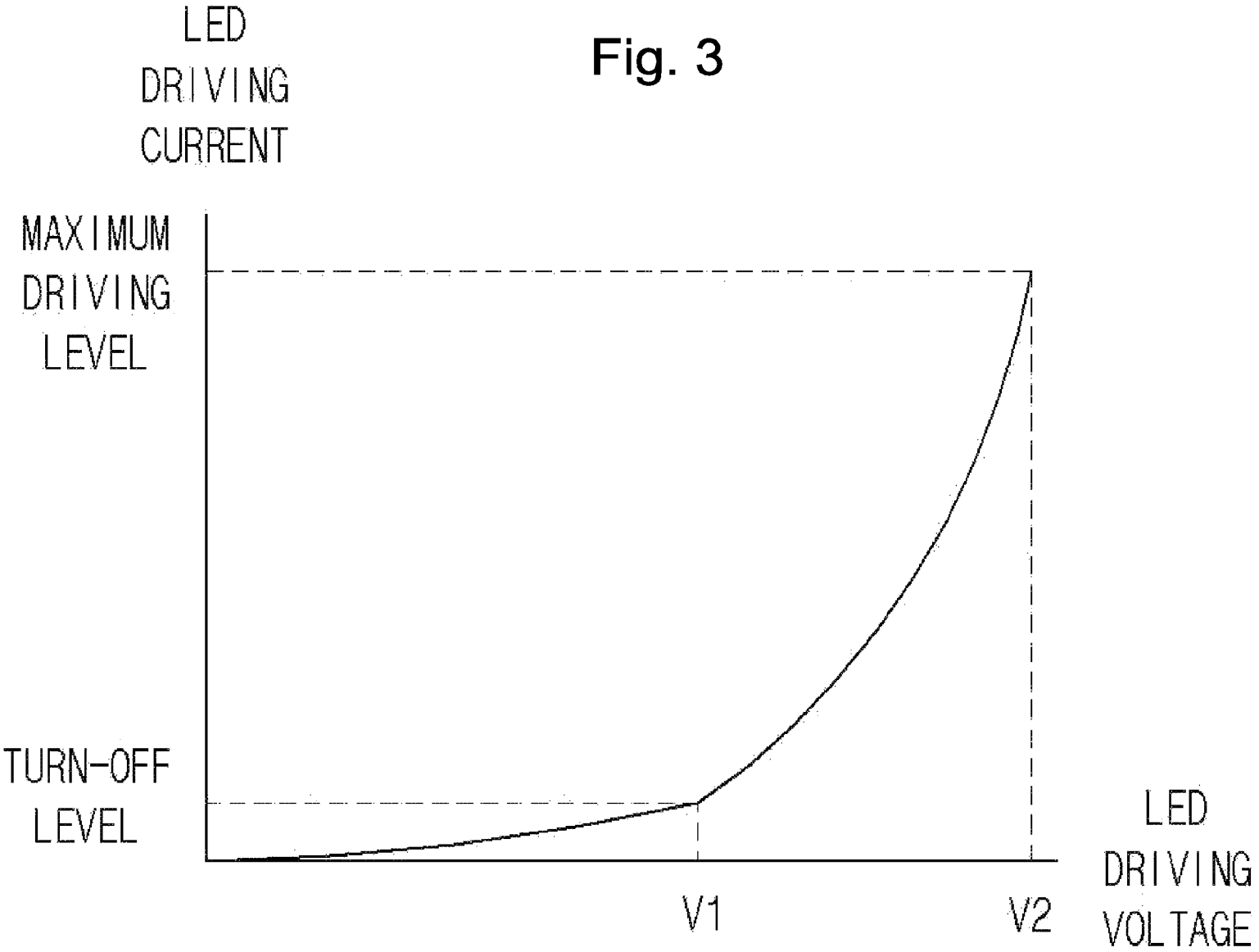
FIG. 3 is a graph showing a correlation between the driving current and the driving voltage of an LED lighting.

More particularly, in accordance with an embodiment of the present invention, current and voltage characteristics supplied from the transformer T to the LED lighting LED may be illustrated as shown in FIG. 3.

Referring to FIG. 3, a driving voltage corresponding to a turn-off level, of currents driven from the transformer T to the LED lighting LED, is defined as V1, and a maximum driving voltage corresponding to a maximum driving current is defined as V2.

In an embodiment of the present invention, a winding ratio of the auxiliary coil L3 may be set to the step-down state (first embodiment), the step-up state (second embodiment), or the center set-up state (third embodiment) by taking the LED driving characteristic of the transformer T of FIG. 3 into consideration, and the DC-DC regulator 18 can operate in response to the set state.

Figure 4:
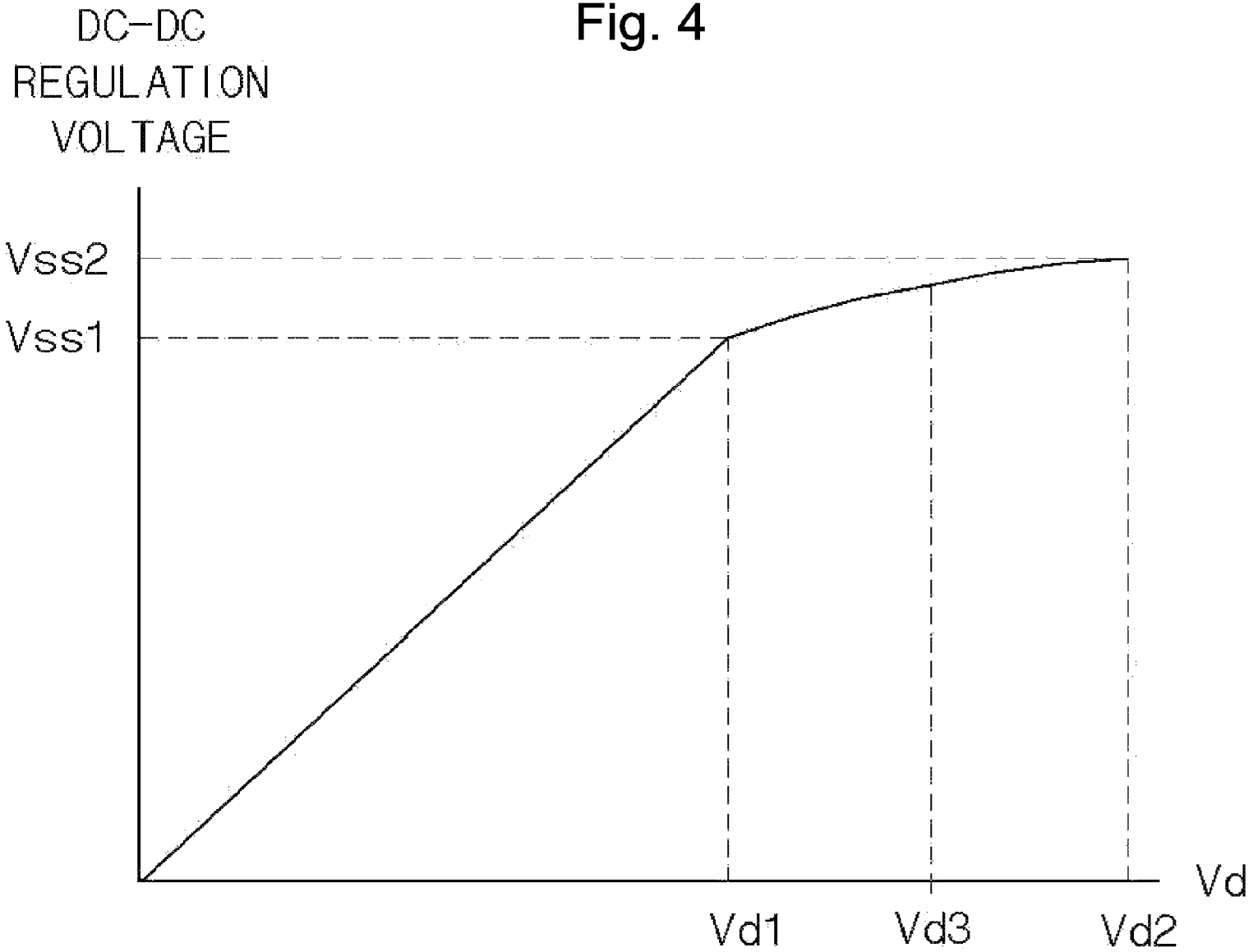
FIG. 4 is a graph showing a correlation between the output voltage and the input voltage of a DC-DC regulator.

In the first embodiment, the winding ratio N2 of the auxiliary coil L3 may be set so that the auxiliary coil L3 outputs the detection voltage Vd as the driving voltage V1 having a level equal to the turn-off level of the LED lighting LED. That is, the detection voltage Vd can be set on the basis of a detection voltage Vd1 of FIG. 4.

For example, if the driving voltage V1 having a level equal to the turn-off level of the LED lighting LED is 18 V, the winding ratio N2 of the auxiliary coil L3 may be set so that the auxiliary coil L3 outputs the detection voltage Vd of the level 18 V.

Furthermore, the DC-DC regulator 18 may be configured to output the detection voltage Vd so that a maximum level of the detection voltage Vd satisfies an allowable range of the operating voltage Vcc.

In the first embodiment of the present invention in which the winding ratio N2 of the auxiliary coil L3 is set to the step-down state, the auxiliary coil L3 can output the driving voltage V1 corresponding to the turn-off level of the LED lighting LED, that is, the detection voltage Vd of 18 V. Here, the auxiliary coil L3 can output the detection voltage Vd of 46 V, for example, in response to a maximum driving voltage of the LED lighting LED.

That is, the detection voltage Vd is detected in a range of 18 V to 46.

The DC-DC regulator 18 converts the maximum level, that is, 46 V, of the detection voltage Vd into voltage of 22 V.

Accordingly, the DC-DC regulator 18 outputs the detection voltage Vd that swings in a range of 18 V to 46 V as an operating voltage Vss that swings in a range of 18 V to 22 V (i.e., the width of Vss1−Vss2).

In contrast, in the second embodiment of the present invention, the winding ratio N2 of the auxiliary coil L3 may be set so that the auxiliary coil L3 outputs the detection voltage Vd in response to the maximum driving voltage V2 of the LED lighting LED. That is, the detection voltage Vd may be set on the basis of a detection voltage Vd2 of FIG. 4.

For example, if the maximum driving voltage V2 of the LED lighting LED is 22 V, the winding ratio N2 of the auxiliary coil L3 may be set so that the auxiliary coil L3 outputs the detection voltage Vd of 22 V.

Furthermore, the DC-DC regulator 18 may be configured so that a minimum level of the detection voltage Vd satisfies an allowable range of the operating voltage Vcc.

In the second embodiment of the present invention in which the winding ratio N2 of the auxiliary coil L3 is set to the step-up state, the auxiliary coil L3 can output the detection voltage Vd corresponding to the maximum driving voltage of the LED lighting LED, that is, the detection voltage Vd of 22 V. Here, the auxiliary coil L3 can output the detection voltage Vd of 7 V, for example, in response to the turn-off level of the LED lighting LED.

That is, the detection voltage Vd is detected in a range of 7 V to 22 V.

Here, the DC-DC regulator 18 converts the minimum level, that is, 7 V, of the detection voltage Vd into voltage of 18 V.

Accordingly, the DC-DC regulator 18 outputs the detection voltage Vd that swings in a range of 7 V to 22 V as the operating voltage Vss that swings in a range of 18 V to 22 V (i.e., the width of Vss1−Vss2).

In contrast, in the third embodiment of the present invention, the winding ratio N2 of the auxiliary coil L3 may be set so that the auxiliary coil L3 outputs the detection voltage Vd having a level corresponding to the middle of a driving voltage for driving the LED lighting LED. The detection voltage Vd can be set based on a detection voltage Vd3 of FIG. 4.

For example, if the center value of the driving voltage of the LED lighting LED is 20 V, the winding ratio N2 of the auxiliary coil L3 may be set so that the auxiliary coil L3 outputs the detection voltage Vd of 20 V.

Furthermore, the DC-DC regulator 18 may be configured so that a minimum level and a maximum level of the detection voltage Vd satisfy an allowable range of the operating voltage Vcc.

In the third embodiment of the present invention in which the winding ratio N2 of the auxiliary coil L3 is set to the step-up state, the auxiliary coil L3 can output the detection voltage Vd having a level corresponding to the center value of the driving voltage of the LED lighting LED, that is, the detection voltage Vd of 20 V. Here, the auxiliary coil L3 may output the detection voltage Vd of 15 V, for example, in response to the turn-off level of the LED lighting LED and may output the detection voltage Vd of 50 V, for example, in response to the maximum driving voltage of the LED lighting LED.

That is, the detection voltage Vd is detected in a range of 15 V to 50 V.

Here, the DC-DC regulator 18 converts the minimum level, that is, 15 V, of the detection voltage Vd into voltage of 18 V and converts the maximum level, that is, 50 V of the detection voltage Vd into voltage of 22 V.

Accordingly, the DC-DC regulator 18 outputs the detection voltage Vd that swings in a range of 7 V to 22 V as the operating voltage Vss that swings in a range of 18 V to 22 V (i.e., the width of Vss1−Vss2).

The DC-DC regulator 18 can output the operating voltage Vss in the width of 18 V to 22 V in accordance with any one of the step-down state (first embodiment), the step-up state (second embodiment), and the center set-up state (third embodiment). The operating voltage Vcc outputted from the DC-DC regulator 18 can be dropped by means of impedance generated by the diode D3 and the capacitor C4 and then supplied to the flyback controller 14 with a level of 14 V.

Accordingly, in accordance with an embodiment of the present invention, although the amount of current induced into the transformer T is changed in response to dimming control, the operating voltage Vss having a stale level can be supplied to the flyback controller 14.

That is, in accordance with an embodiment of the present invention, the light emission of an LED can be stabilized because the flyback control circuit can operate stably.

As is apparent from the above description, in accordance with an embodiment of the present invention, there is an advantage in that an LED can emit light stably because an operating voltage can be stably supplied to the flyback control circuit although dimming control is performed in a turn-off level.

Furthermore, in accordance with an embodiment of the present invention, voltage regulation is performed on a detection voltage outputted from the auxiliary coil whose winding ratio is set to any one of the step-down state, the step-up state, and the center set-up state. Accordingly, there are advantages in that a stable operating voltage can be supplied to the flyback control circuit and the light emission of an LED lighting can be stabilized.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A power supply apparatus for an LED lighting, comprising:

a power source unit configured to supply a rectified voltage;

a voltage converter configured to comprise at least one first inductor and to convert the rectified voltage;

an auxiliary coil configured to comprise a second inductor and to supply a detection voltage corresponding to current of the first inductor of the voltage converter;

a controller configured to control current of the voltage converter using a driving pulse generated in response to a control signal and a sensing voltage; and a voltage regulation circuit configured to regulate the detection voltage and to supply the regulated voltage as an operating voltage for the controller, wherein the control signal controls a dimming of an LED lighting, and the sensing voltage is voltage fed back after sensing the current of the voltage converter, and wherein the voltage regulation circuit comprises:

a constant voltage circuit configured to supply a constant voltage in response to the detection voltage; and a DC-DC regulator driven by the constant voltage and configured to change an upper limit of the detection voltage so that the upper limit satisfies an allowable range of the operating voltage and to supply the changed voltage as the operating voltage.

2. The power supply apparatus of claim 1, wherein a winding ratio of the first inductor and the second inductor is set so that the detection voltage is included in a driving voltage region of the LED lighting.

3. The power supply apparatus of claim 2, wherein:

the driving voltage region is defined as a first voltage and a second voltage lower than the first voltage, and the winding ratio is set so that the detection voltage is outputted as the second voltage.

4. The power supply apparatus of claim 2, wherein:

the driving voltage region is defined as a first voltage and a second voltage lower than the first voltage, and the winding ratio is set so that the detection voltage is outputted as the first voltage.

5. The power supply apparatus of claim 2, wherein:

the driving voltage region is defined as a first voltage and a second voltage lower than the first voltage, and the winding ratio is set so that the detection voltage is outputted as a middle voltage between the first voltage and the second voltage.

6. The power supply apparatus of claim 1, wherein the auxiliary coil is configured in the voltage converter.

7. The power supply apparatus of claim 1, wherein the auxiliary coil is combined with the voltage converter in a non-separation or separation way.

8. The power supply apparatus of claim 1, wherein the control signal is provided as an analog signal or a PWM signal.

9. The power supply apparatus of claim 1, wherein the constant voltage circuit comprises a zener diode.

10. The power supply apparatus of claim 1, wherein the DC-DC regulator comprises an NPN transistor having a collector and a base coupled through a resistor.

11. The power supply apparatus of claim 1, wherein the controller comprises:

a dimming control circuit configured to convert an external control signal for controlling dimming into a dimming control signal having a DC component;

a Zero Current Detection circuit configured to detect a zero current point of current outputted from the auxiliary coil and to output a ZCD signal corresponding to the zero current point;

a switching element switched in response to the driving pulse and configured to drive a flow of the current of the voltage converter;

a sensing element connected to the switching element and configured to provide the sensing voltage by sensing a flow of current of the switching element; and a flyback controller driven by the operating voltage and configured to supply the switching element with the driving pulse having a pulse width determined in response to the dimming control signal and the sensing voltage, wherein a point of time at which the driving pulse is started is synchronized with the zero current point in response to the ZCD signal ◇||.

12. The power supply apparatus of claim 1, further comprising a sensor board configured to operate in response to an output of the voltage converter and to supply the control signal for controlling the dimming of the LED lighting.

13. An LED lighting apparatus, comprising:

an LED lighting;

a sensor board configured to provide a control signal for controlling a dimming of the LED lighting; and a power supply apparatus configured to comprise a power source unit configured to supply a rectified voltage, a voltage converter configured to comprise at least one first inductor and to convert the rectified voltage, an auxiliary coil configured to comprise a second inductor and to supply a detection voltage corresponding to current of the first inductor of the voltage converter, a controller configured to control current of the voltage converter using a driving pulse generated in response to the control signal and a sensing voltage fed back after sensing the current of the voltage converter, and a voltage regulation circuit configured to regulate the detection voltage and to supply the regulated voltage as an operating voltage for the controller and to supply a power to the LED lighting and the sensor board.

14. The LED lighting apparatus of claim 13, further comprising a startup circuit configured to detect a startup current supplied from the power source unit to the voltage converter in an initial state in which AC power starts being supplied and to supply the operating voltage to the controller.

15. The LED lighting apparatus of claim 13, wherein a winding ratio of the first inductor and the second inductor is set so that the detection voltage is included in a driving voltage region of the LED lighting.

16. The LED lighting apparatus of claim 15, wherein:

the driving voltage region is defined as a first voltage and a second voltage lower than the first voltage, and the winding ratio is set so that the detection voltage is outputted as the second voltage.

17. The LED lighting apparatus of claim 15, wherein:

the driving voltage region is defined as a first voltage and a second voltage lower than the first voltage, and the winding ratio is set so that the detection voltage is outputted as the first voltage.

18. The LED lighting apparatus of claim 15, wherein:

the driving voltage region is defined as a first voltage and a second voltage lower than the first voltage, and the winding ratio is set so that the detection voltage is outputted as a middle voltage between the first voltage and the second voltage.

19. The LED lighting apparatus of claim 13, wherein the auxiliary coil is combined with the voltage converter in a non-separation or separation way.

* * * * *